US006517054B2

(12) United States Patent
Samejima

(10) Patent No.: US 6,517,054 B2
(45) **Date of Patent: *Feb. 11, 2003**

(54) LEVER HOIST WITH OVERLOAD PREVENTING DEVICE

(75) Inventor: Yasuhiro Samejima, Osaka (JP)

(73) Assignee: Vital Kogyo Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/840,427

(22) Filed: Apr. 23, 2001

(65) Prior Publication Data

US 2002/0153519 A1 Oct. 24, 2002

(51) Int. Cl.[7] ..... B66D 1/14
(52) U.S. Cl. ..... 254/352; 254/346
(58) Field of Search ..... 254/346, 350, 254/352, 368, 372

(56) References Cited

U.S. PATENT DOCUMENTS 4,768,754 A * 9/1988 Nishimura ..... 254/351
5,088,694 A * 2/1992 Nishimura ..... 254/352
5,238,226 A * 8/1993 Nishimura ..... 254/352
5,769,398 A * 6/1998 Samejima ..... 192/95
6,059,267 A * 5/2000 Nishimura ..... 192/95
6,352,243 B1 * 3/2002 Samejima ..... 254/346

* cited by examiner

*Primary Examiner*—William A. Rivera
(74) *Attorney, Agent, or Firm*—Vedder Price Kaufman & Kammholz

(57) ABSTRACT

A lever hoist with an overload preventing device comprises a pressing member for rotatably pressing a pressed member via a reverse rotation preventing ring and a pair of friction members, and a rotation drive member capable of transmitting rotating force of a chain wheel to the pressing member and movable in an axial direction. The rotation drive member is urged toward the pressing member by a disk spring. Locking teeth are formed at surfaces facing each other, of the pressing member and the rotation drive member, respectively. Respective pressed surfaces during a hoisting-down operation, of the locking teeth are sharply inclined, while respective pressed surfaces during a hoisting-up operation are moderately inclined. A rotation limiting member is interposed between the rotation drive member and the disk spring. Even if the rotation drive member is rotated in an overload state, the rotating force of the rotation drive member cannot be transmitted to the disk spring and a nut.

1 Claim, 4 Drawing Sheets

LEVER HOIST WITH OVERLOAD PREVENTING DEVICE

BACKGROUND OF THE INVENTION

1. Field of the Invention

The present invention relates to a lever hoist with an overload preventing device.

2. Related Art

There has been a lever hoist in which rotation drive force is transmitted to a pressing member screwed in such a manner as to freely advance or retreat on a drive shaft by an operating lever, and a pressed member fixed to the drive shaft is pressed to be rotated by the pressing member via a reverse rotation preventing ring and a pair of friction members disposed at both surfaces of the ring.

Some types of overload preventing devices applied to the above-described lever hoist have conventionally used friction force, and have been configured such that a slide is generated between members so as to prevent any transmission of rotating force to the pressing member in the case where an overload is hoisted down.

However, in the conventional configuration, for example, a friction plate system, it has taken much time to adjust pressing force for the purpose of load limit setting since the pressing force to be exerted on a friction plate must be adjusted. Moreover, since it has been inevitable that the friction plate is worn out, a load limit has been varied as the friction plate is consumed. As measures against this, the pressing force has been required to be appropriately adjusted.

SUMMARY OF THE INVENTION

The present invention has been accomplished in view of the above-described circumstances. A primary object of the present invention is to provide a lever hoist with an overload preventing device, capable of easily setting a maximum hoisted load.

According to the present invention, a lever hoist with an overload preventing device comprises: a drive shaft for transmitting rotating force to a load sheave; a pressed member fixed to the drive shaft; a reverse rotation preventing ring which is rotated in only one direction with respect to the drive shaft; a pressing member screwed to the drive shaft in such a manner as to freely advance or retreat and disposed with the reverse rotation preventing ring held therebetween; a large-diameter boss projecting from the pressing member toward an axial tip; a small-diameter boss projecting from the large-diameter boss toward the axial tip and having a screw groove formed at the circumferential surface thereof; a rotation drive member rotatably fitted to the large-diameter boss of the pressing member in such a manner as to face the pressing member in the axial direction and having a drive tooth on the outer periphery thereof; a plurality of locking teeth, each having a triangular cross section, which are formed at respective circumferential surfaces facing each other, of the pressing member and the rotation drive member, so as to mesh with each other; a moderately inclined surface defining the locking tooth, for pressing the pressing member when the rotation drive member is rotated in a hoisting-up direction; a sharply inclined surface defining the locking tooth, for pressing the pressing member when the rotation drive member is rotated in a hoisting-down direction; an engaging portion formed at the projecting portion of the large-diameter boss projecting toward the tip beyond the rotation drive member when the rotation drive member is fitted to the large-diameter boss; a rotation limiting member having an outer diameter greater than the inner diameter of the rotation drive member, for restricting, at the outer peripheral edge thereof, movement toward the axial tip of the rotation drive member, and including, at the inner circumference thereof, an engaged portion to be engaged with the engaging portion at the tip of the large-diameter boss so as to inhibit relative rotation in a circumferential direction; urging means fitted to the small-diameter boss nearer the axial tip than the rotation limiting member, and having urging force such that it cannot ride over the sharply inclined surface of the locking tooth when the rotation drive member is rotated in the hoisting-down direction during a hoisting-down operation while it can ride over the moderately inclined surface of the locking tooth when an overload is exerted on the rotation drive member during a hoisting-up operation; and a nut screwed into the small-diameter boss, for positioning the urging means with respect to the pressing member.

PREFERRED EMBODIMENT OF THE INVENTION

A detailed description will be given below of a lever hoist according to the present invention.

Figure 1:
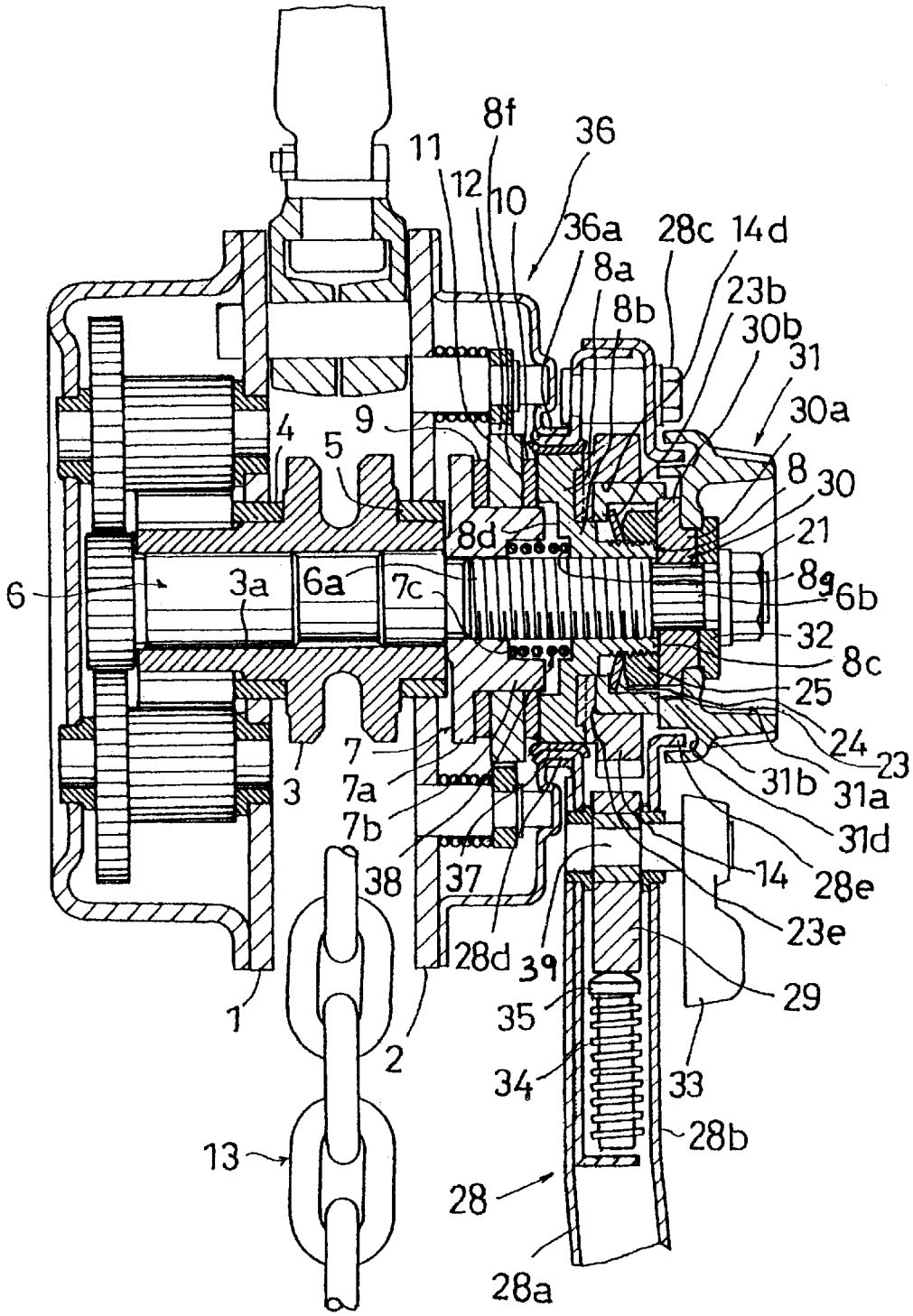
FIG. 1 is a cross sectional view showing a lever hoist in a preferred embodiment according to the present invention.
Figure 2:
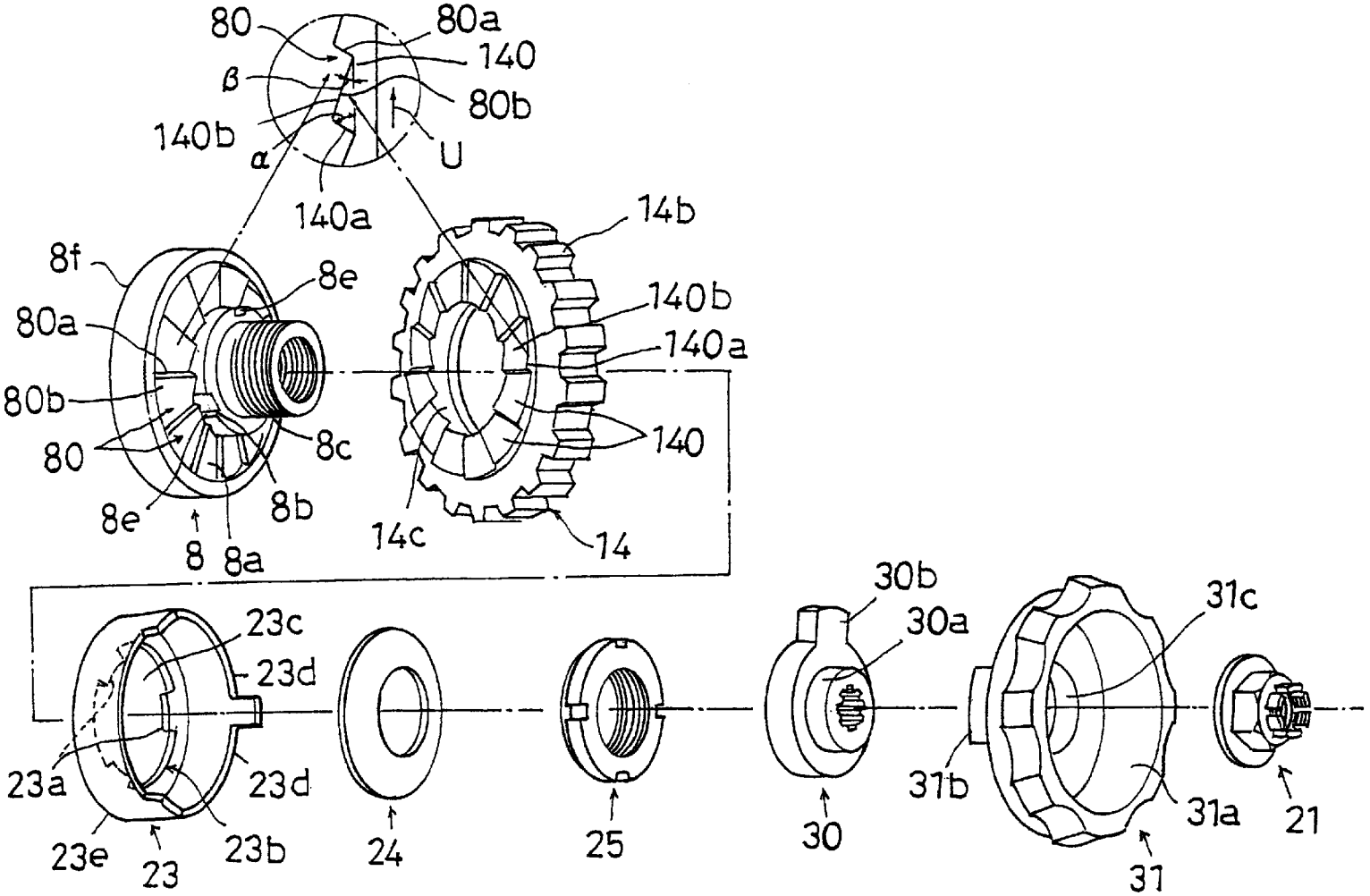
FIG. 2 is an exploded perspective view showing essential parts of the lever hoist in the preferred embodiment shown in FIG. 1.

FIG. 1 is a cross sectional view showing a lever hoist in a first embodiment according to the present invention; and FIG. 2 is an exploded perspective view showing essential parts of an overload preventing device in the lever hoist in the present embodiment.

In FIG. 1, a load sheave 3 is interposed between a pair of side plates 1 and 2 held in parallel at a predetermined interval. The load sheave 3 is rotatably held by bearings 4 and 5 supported by the side plates 1 and 2, respectively. A shaft hole 3*a* is formed through the center of the load sheave 3. A drive shaft 6 is rotatably inserted into the shaft hole 3*a*. Both ends of the drive shaft 6 project from right and left ends of the load sheave 3, respectively.

The left projecting portion of the drive shaft 6 is connected to the load sheave 3 via a reduction gear transmission system. In contrast, at the right projecting portion of the drive shaft 6 is formed a first screw 6*a*, which is provided with means for driving the load sheave 3. Namely, a pressed member 7 and a pressing member 8 are screwed to the first screw 6*a* of the drive shaft 6 in order from the side plate 2. The pressed member 7 is screwed into the innermost portion of the first screw 6*a*, to be thus fixed to the drive shaft 6.

The pressed member 7 includes a large-diameter disk 7*a* and a small-diameter boss 7*b* in a manner coaxial with each other. The disk 7*a* is formed near the side plate 2, and the boss 7*b* is formed in such a manner as to project from the center of the disk 7*a* toward an axial tip of the drive shaft 6

(i.e., rightward in FIG. 1). A reverse rotation preventing ring 11 is fitted around the boss 7*b* of the pressed member 7 while being held between a pair of friction members 9 and 10. The reverse rotation preventing ring 11 and the friction members 9 and 10 disposed on both sides of the ring 11 are configured such that they can be pressed against the disk 7*a* of the pressed member 7 by the pressing member 8.

The reverse rotation preventing ring 11 is provided, on the outer periphery thereof, with locking teeth 11*a* inclined in one direction on the circumference. When the locking teeth 11*a* mesh with a ratchet pawl 12 pivoted on the side plate 2, the reverse rotation preventing ring 11 can be prevented from being rotated reversely, to be thus rotated in one direction with respect to the drive shaft, that is, only in a hoisting-up direction.

Consequently, the pressing member 8 is rotated in the hoisting-up direction, and therefore, is moved toward an axial base end (leftward in FIG. 1) along the drive shaft 6, thereby pressing the friction members 9 and 10 and the reverse rotation preventing ring 11 against the disk 7*a* of the pressed member 7. Finally, the pressing member 8 is connected to the pressed member 7. In this manner, the rotation of the pressing member 8 is transmitted to the load sheave 3 via the pressed member 7, the drive shaft 6 and the reduction gear transmission system, so that a load mounted on a link chain 13 wound around the load sheave 3 can be hoisted up.

The pressing member 8 includes a flange 8*a* having a circular pressing surface 8f on the side of the pressed member 7, i.e., at the axial base end, a large-diameter boss 8*b* projecting from the center at the axial base end of the flange 8*a*, and a small-diameter boss 8*c* at the tip of the large-diameter boss 8*b*. An insertion hole 8*d*, into which the axial tip of the boss 7*b* of the pressed member 7 is slightly inserted, is formed at the center at the axial base end of the flange 8*a*, as shown in FIG. 1. The diameter of the insertion hole 8*d* is somewhat greater than the outer diameter of the boss 7*b* of the pressed member 7, thereby preventing any direct contact of the boss 7*b* of the pressed member 7 with the pressing member 8. The circular pressing surface 8*f* of the flange 8*a* of the pressing member 8 can abut against the friction member 10.

Furthermore, locking teeth 80, 80 . . . are formed at the axial tip surface of the flange 8*a* of the pressing member 8 and at the disk surface outward of the large-diameter boss 8*b*. Each of the locking teeth 80 is formed into the same shape continuously in the circumferential direction.

As shown in FIG. 2, each of the locking teeth 80 of the pressing member 8 is formed into a substantially triangular shape in such a manner as to project toward the axial tip.

Namely, a surface 80*a* to be pressed during a hoisting-down operation, of each of the locking teeth 80 (hereinafter referred to as a pressed surface during a hoisting-down operation) is sharply inclined. The sharply inclined surface signifies a surface angled such that the locking teeth cannot ride over when a rotation drive member, described later, is rotated in a hoisting-down direction, and thus, is formed into a substantially vertical surface which is substantially vertically raised with respect to the axial tip surface of the flange 8*a* so as to extend toward the axial tip, or into an inclined surface raised at a great angle from the axial tip surface of the flange 8*a*. Such an inclination angle is set such that the inclined surface is inclined in the hoisting-down direction raised at an angle $\alpha$ from the axial tip surface of the flange 8*a* of the pressing member 8 of, for example, about 90° to 45° and, preferably about 70° to 50° (60° in the illustration). The formation of the sharply inclined surface can prevent the locking tooth from riding over the surface when the rotation drive member, described later, is rotated in the hoisting-down direction. Additionally, the formation of the sharply inclined surface can generate an alarm sound if a hoisting-up operation is performed in an overload state, as described later.

In contrast, a surface 80*b* to be pressed during a hoisting-up operation, of each of the locking teeth (hereinafter referred to as a pressed surface during a hoisting-up operation) is moderately inclined. In the pressed surface 80*b* during the hoisting-up operation, an inclination angle $\beta$ with respect to the axial tip surface of the flange 8*a* of the pressing member 8 is set to about 10° to 30° (20° in the illustration), and the inclination with respect to the axial tip surface of the flange 8*a* is sufficiently more moderate than that of the pressed surface 80*a* during the hoisting-down operation. The moderately inclined surface signifies an inclined surface having an inclination angle at which the locking tooth can ride over the surface against urging force of urging means when an overload is exerted on the rotation drive member during the hoisting-up operation.

The crest of the locking tooth 80, i.e., a crossing portion between the pressed surface 80*a* during the hoisting-down operation and the pressed surface 80*b* during the hoisting-up operation is chamfered in an arcuate shape. In FIG. 2, an arrow U indicates the hoisting-up direction. Moreover, in the illustration, a trough formed between the adjacent locking teeth 80 is substantially identical in shape to and reverse in orientation to the crest of the locking tooth 80.

The boss portion of the pressing member 8 is formed at two stages in the tip direction. In other words, the large-diameter boss 8*b* is formed at the base end, while the threaded small-diameter boss 8*c* is formed at the tip. Around the large-diameter boss 8*b* of the pressing member 8 is fitted the rotation drive member 14 from the tip.

At the axial base end of the rotation drive member 14 are formed locking teeth 140, 140 . . . capable of meshing with the locking teeth 80 of the pressing member 8 in such a manner as to project toward the axial base end. Each of the locking teeth 140 of the rotation drive member 14 is formed into a shape substantially in conformity with a recessed groove formed between the locking teeth 80, 80 of the pressing member 8. In the illustration, each of the locking teeth 140 of the rotation drive member 14 is formed into a triangular shape substantially identical but reverse to the locking tooth 80 of the pressing member 8.

Specifically, each of the locking teeth 140 of the rotation drive member 14 has a pressed surface 140*a* during the hoisting-down operation, which is formed into a sharply inclined surface. The inclination angle of the sharply inclined surface is set in such a manner that the pressed surface 140*a* during the hoisting-down operation corresponds to the pressed surface 80*a* during the hoisting-down operation, of the pressing member 8. In contrast, a pressed surface 140*b* during the hoisting-up operation is formed into a moderately inclined surface in a manner similar to the pressed surface 80*b* during the hoisting-up operation, of the pressing member 8.

Incidentally, each of the locking teeth 80 and 140 of the pressing member 8 and the rotation drive member 14, respectively is subjected to quenching.

At the peripheral surface of the rotation drive member 14 is formed a gear 14*b* capable of meshing with a rotating direction switching pawl 29 in an operating lever 28. The large-diameter boss 8*b* of the pressing member 8 is inserted into a center hole 14*c* formed at the rotation drive member 14 in such a manner as to freely move in the axial direction at the axial base end of the large-diameter boss 8*b*.

A circular recess 14*d* is formed at the tip end of the rotation drive member 14, and thus, contains therein a rotation limiting member 23. The rotation limiting member 23 is formed into a substantially cylindrical shape, and an inward flange 23*b* is formed at its axial base end in such a manner as to extend inward in a radial direction. A circular fixing hole 23*c* is formed through the center of the flange 23*b*. Additionally, a plurality of engaged recesses 23*d*, 23*d* . . . are formed at the axial tip of the cylindrical rotation limiting member 23 at equal intervals in the circumferential direction, as shown in FIG. 2. In the illustration, there are three engaged recesses 23*d* cut out into a substantially rectangular shape.

The large-diameter boss 8*b* of the pressing member 8 is inserted into the fixing hole 23*c* of the rotation limiting member 23, which is then fitted at the axial tip of the large-diameter boss 8*b*. One or a plurality of substantially rectangular engaging projections 23*a* (three in the illustration) are formed at the fixing hole 23*c* of the rotation limiting member 23 in such a manner as to project from the flange 23*b* inward in the radial direction. The engaging projection 23*a* engages with an engaged recess 8*e* formed at the periphery of the large-diameter boss 8*b*. The engaged recess 8*e* is opened toward the axial tip. Consequently, the rotation limiting member 23 and the pressing member 8 are fixed in the state in which the relative rotation in the circumferential direction is restricted, although the rotation limiting member 23 can freely move in the axial direction with respect to the pressing member 8. The profile of the base end of the rotation limiting member 23 has an outer diameter greater than the inner diameter of the rotation drive member 14, and further, a peripheral edge constitutes a restricting portion 23*e* capable of restricting the movement of the rotation drive member 14 toward the axial tip.

The rotation limiting member 23 and the rotation drive member 14 such configured as described above are sandwiched between the pressing member 8 and a disk spring 24. The engaging projections 23*a* engage with the engaged recesses 8*e* via the rotation limiting member 23, thereby preventing the disk spring 24 from being rotated together with the rotation drive member 14, and further, inhibiting the disk spring 24 from being rotated in the circumferential direction so as to prevent any excessive tightening of a nut 25. Consequently, it is possible to prevent any variation of the urging force of the disk spring serving as urging means during operation.

The disk spring 24 exerts the urging force so as to press the rotation drive member 14 toward the axial base end (i.e., toward the pressing member 8) via the rotation limiting member 23. With high positioning rigidity among the members, the diameter and thickness of the disk spring 24 are previously determined, and thus, the disk spring 24 can be configured in such a manner as to cope with a predetermined load limit by screwing the nut 25 by the same quantity. In other words, it is possible to dispense with adjustment of the load limit, thereby enhancing adjusting efficiency.

The rotation drive member 14 and the rotation limiting member 23 are fitted in order around the large-diameter boss 8*b* of the pressing member 8 from the axial tip, so that the engaging projections 23*a* formed at the inner circumference of the rotation limiting member 23 engage with the engaged recesses 8*e* of the pressing member 8. Subsequently, after the disk spring 24 is fitted to the pressing member 8, the nut 25 is screwed into the screw 8*c* of the pressing member 8. In this manner, the disk spring 24 urges the rotation limiting member 23 and the rotation drive member 14 toward the axial tip, to thus press the rotation drive member 14 against the pressing member 8.

In the drive shaft 6, a spline 6*b* is formed at the axial tip of the first screw 6*a* with the pressing member 8 screwed thereto. To the spline 6*b* is fitted a rotation angle restricting member 30 adjacently to the pressing member 8.

Figure 3:
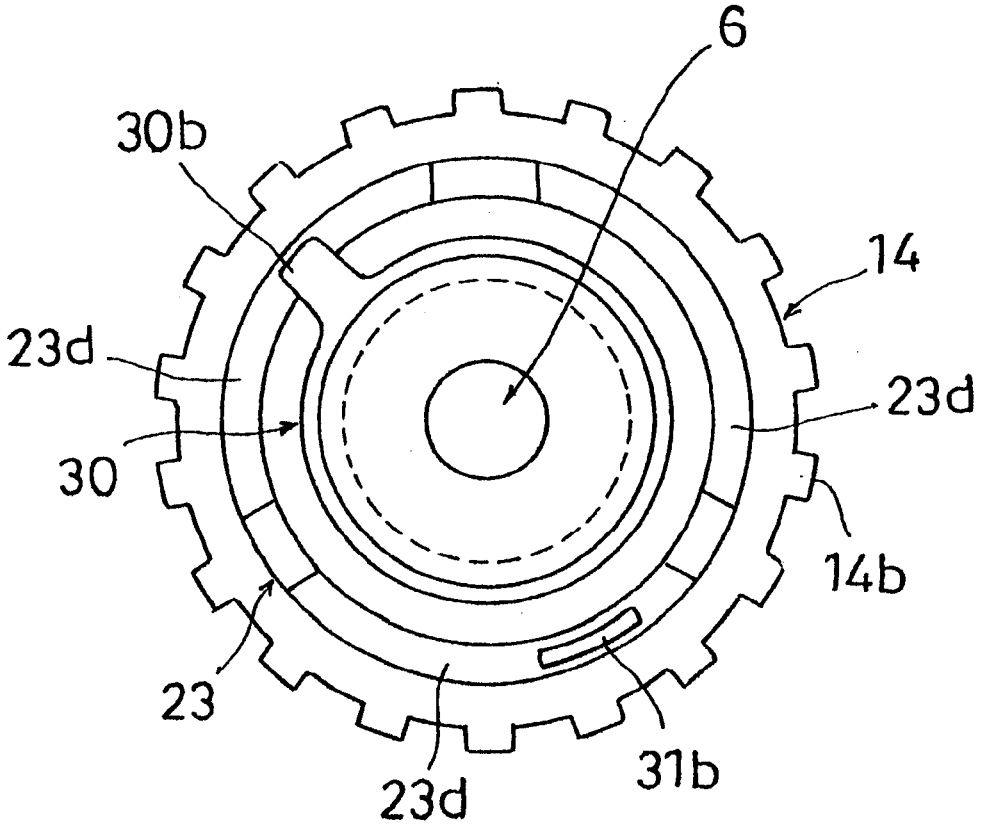
FIG. 3 is a schematic side view showing the inside configuration at a base end, as viewed from an axial tip, in an assembled state in the preferred embodiment shown in FIG. 2.
Figure 4:
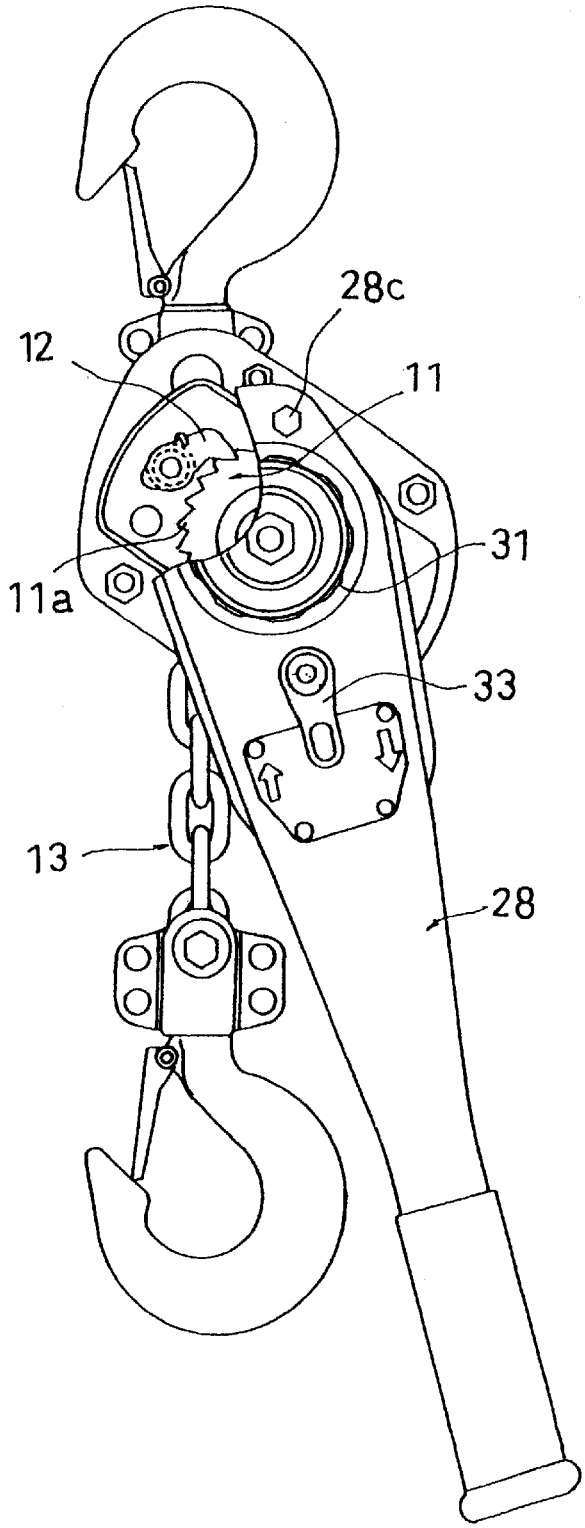
FIG. 4 is a front view showing the entire appearance in the preferred embodiment.

The rotation angle restricting member 30 is provided with a boss 30*a* oriented toward the axial tip. Furthermore, in the rotation angle restricting member 30, one rotation angle restricting projection 30*b* is formed in such a manner as to project in a substantially rectangular shape outward in the radial direction. The rotation angle restricting member 30 is fixed to the drive shaft 6 in the state in which the rotation angle restricting projection 30*b* is located at one of the engaged recesses 23*d* of the rotation limiting member 23. Incidentally, the circumferential width of the rotation angle restricting projection 30*b* is sufficiently smaller than the circumferential length of the engaged recess 23*d* of the rotation limiting member 23, as shown in FIG. 3.

In this manner, the rotation angle restricting projection 30*b* projects inward of the engaged recess 23*d* of the rotation limiting member 23. The side wall of the engaged recess 23*d* abuts against the rotation angle restricting projection 30*b*, thereby preventing any excessive rotation of the pressing member 8 with respect to the drive shaft 6. Consequently, it is possible to prevent any unnecessary movement of the pressing member 8 toward the axial tip.

Around the boss 30*a* of the rotation angle restricting member 30, an operating ring 31 is rotatably fitted to the rotation angle restricting member 30. The operating ring 31 is provided with a recess 31*a* opened toward the axial tip. Moreover, a pressing releasing projection 31*b* capable of intruding into the engaged recess 23*d* of the rotation limiting member 23 is formed at the bottom wall of the operating ring 31 facing the rotation limiting member 23.

The engaged recess 23*d* at which the pressing releasing projection 31*b* is located is different from the engaged recess 23*d* at which the rotation angle restricting projection 30*b* is located. Namely, in FIG. 3 showing the base end as viewed from the axial tip, the pressing releasing projection 31*b* is located at a next engaged recess 23*d* adjacently in the hoisting-down direction. Collision of the pressing releasing projection 31*b* against the rotation limiting member 23 causes the rotation limiting member 23 and the pressing member 8 to be forcibly rotated in the hoisting-down direction, thus achieving the movement of the pressing member 8 toward the axial end.

The operating ring 31 is positioned by tightening a nut 21 to a second screw of the drive shaft 6 via a washer 32 inside of the recess 31*a*. The outer diameter of the washer 32 is slightly greater than the diameter of a shaft hole 31*c* formed on the bottom wall of the operating ring 31. Therefore, the operating ring 31 cannot be detached from the rotation angle restricting member 30 even when the operating ring 31 is pulled toward the axial tip, so that there is no danger that the pressing releasing projection 31*b* may be detached from the engaged recess 23*d*.

The gear 14*b* of the rotation drive member 14 is contained inside the operating lever 28. The operating lever 28 includes an inside case 28*a* and an outside case 28*b*, which engage with each other to be integrally connected via a plurality of bolts/nuts 28*c*. The inside case 28*a* has a cylindrical opening 28*d* surrounding the vicinity of the flange 8*a* of the pressing member 8. The outside case 28*b* also has a cylindrical opening 28*e* to be inserted into an annular groove 31*d* formed on the bottom wall of the operating ring 31.

The operating lever 28 extends downward of the rotation drive member 14, and further, includes therein the rotating direction switching pawl 29. The rotating direction switching pawl 29 is rotatably held by a shaft 39 with respect to both of the cases 28*a* and 28*b*. The shaft 39 projects outward of the operating lever 28, and further, a switching lever 33 is fixed to the projecting portion of the shaft 39.

The switching lever 33 is switched such that the rotating direction switching pawl 29 engages to allow the rotation drive member to be rotated in the hoisting-up direction (UP) or the hoisting-down direction (DOWN). Otherwise, the rotating direction switching pawl 29 is held at a neutral position, at which the rotation drive member is not rotated in either direction. A pressing member 35, which is urged upward by a spring 34, abuts against the lower end of the rotating direction switching pawl 29, so that the rotating direction switching pawl 29 can be resiliently held at a predetermined switching position.

The cylindrical opening 28*d* formed at the inside case 28*a* is fitted to one end (a cylindrical opening) 36*a* of a brake cover 36. In this manner, the operating lever 28 can turnably reciprocate around the cylindrical opening 36*a* of the brake cover 36. The members from the pressed member 7 to the operating ring 31 are covered with the brake cover 36 and the operating lever 28. The other end of the brake cover 36 is fixed to the side plate 2 via a plurality of bolts/nuts. Incidentally, a stopper cylinder member 37 having a U-shaped cross section for restricting the axial movement of the operating lever 28 is fitted at the inner surface of the cylindrical opening 28*d* formed at the inside case 28*a*.

As shown in FIG. 1, a counterclockwise coil spring 38 is interposed between the pressed member 7 and the pressing member 8. Namely, spring disposing holes 7*c* and 8*g* are respectively formed at the surfaces at which the pressed member 7 and the pressing member 8 face each other, and then, the ends of the counterclockwise coil spring 38 loosely fitted to the drive shaft 6 are inserted into the spring disposing holes 7*c* and 8*g*, respectively.

The base end locking portion of the counterclockwise coil spring 38 engages with the pressed member 7 while the tip locking portion thereof engages with the pressing member 8, thus urging the pressing member 8 in the hoisting-down direction. Namely, rotating force in the hoisting-down direction is exerted on the pressing member 8 in such a manner as to allow the pressing member 8 to spirally retreat along the drive shaft 6. Consequently, the pressing member 8 is rotated in the hoisting-up direction against the urging force of the coil spring 38, so that the pressed member 7 is pressed and rotated via the reverse rotation preventing ring 11 and the pair of friction members 9 and 10 disposed at both surfaces of the ring 11, thereby achieving the hoisting-up operation.

Subsequently, explanation will be made on the operation of the lever hoist according to the present invention.

In the case where a load lighter than the load limit is hoisted up, the switching lever 33 is switched in the hoisting-up direction (UP), and then, the operating lever 28 is turned lengthwise on the drive shaft 6 in a reciprocating manner. Moreover, in the case where the load is hoisted down, the switching lever 33 is switched in the hoisting-down direction (DOWN), and then, the operating lever 28 is turned lengthwise on the drive shaft 6 in a reciprocating manner.

In the above-described case, the reciprocating motion of the operating lever 28 causes the rotating direction switching pawl 29 to rotate the rotation drive member 14, so that the rotation drive force is transmitted to the pressing member 8 via the friction force of the locking teeth 140 and 80, thereby achieving the hoisting-up or -down operation of the load.

In contrast, in the case where an overload is hoisted, the pressing member 8 cannot be rotated even if the rotation drive member 14 is rotated, and therefore, the pressed surface 140*b* during the hoisting-up operation, of the locking tooth 140 slides on the pressed surface 80*b* during the hoisting-up operation, of the locking tooth 80 of the pressing member 8. In other words, the rotation drive member 14 slides while being slightly pressed back to the axial tip against the urging force of the disk spring 24. Finally, the locking tooth 140 of the rotation drive member 14 rides over the locking tooth 80 of the pressing member 8, and then, is fittingly contained in a subsequent groove defined between the locking teeth 80, 80 of the pressing member 8 by the urging force of the disk spring 24.

In this manner, when the rotation drive member 14 is rotated in the hoisting-up direction in the overload state, only the rotation drive member 14 is rotated although the pressing member 8 cannot be rotated. Consequently, since the pressing member 8 cannot be rotated forward, the load cannot be hoisted up. That is to say, the hoisting-up operation is prevented in the overload state.

In addition, when the locking tooth 140 of the rotation drive member 14 rides over the locking tooth 80 of the pressing member 8, it is fitted into a subsequent groove with a flick. Such a flick as an alarm can notify a user of the overload state.

In the meantime, since the pressed surface 140*a* during the hoisting-down operation, of the locking tooth 140 of the rotation drive member 14 and the pressed surface 80*a* during the hoisting-down operation, of the locking tooth 80 of the pressing member 8 are sharply inclined, the locking tooth 140 of the rotation drive member 14 cannot ride over the locking tooth 80 of the pressing member 8 in the hoisting-down direction. Namely, the rotating force of the rotation drive member 14 can be transmitted to the pressing member 8 in the hoisting-down direction even in the overload state. Therefore, even if a heavy load should be exerted during the load hoisting-up operation to cause the overload state, the pressing member 8 can be rotated in the hoisting-down direction, so that the load can be forcibly hoisted down.

Furthermore, when the rotation drive member 14 is rotated in the hoisting-up direction in the overload state, the rotation drive member 14 is rotated while deformably compressing the disk spring 24, to thus exert great urging force on the disk spring 24 and the nut 25. However, the rotation limiting member 23 is interposed between the rotation drive member 14 and the disk spring 24, and the engaging projection 23*a* of the rotation limiting member 23 engages with the engaged recess 8*e* of the pressing member 8. Consequently, the rotating force of the rotation drive member 14 with respect to the pressing member 8 cannot be transmitted to the disk spring 24 and the nut 25. Therefore, even in the case where the rotation limiting member 23 is rotated in the overload state, the nut 25 cannot be tightened, and therefore, there is no danger of variations in the preset load limit.

Additionally, a loose rotation can be generally achieved by setting the switching lever 33 at a neutral position. However, in the lever hoist according to the present invention, since the counterclockwise coil spring 38 is interposed between the pressed member 7 and the pressing member 8, the pressing member 8 is once released from the pressed member 7 while the switching lever 33 is set at a neutral position in an unload state, and then, the pressing member 8 is rotated in the hoisting-down direction by the urging force of the counterclockwise coil spring 38, moves toward the axial tip along the first screw 6*a* of the drive shaft 6, and finally, releases the pressing with respect to the friction member 10. Even unless the pressing member 8 is rotated all the time in the hoisting-down direction by operating the operating ring 31, the pressing member 8 can be loosely rotated in a continuous manner by slowly pulling up the chain 13. The side wall of the engaged recess 23*d* of the rotation limiting member 23 engaging with the pressing member 8 in the circumferential direction abuts against the rotation angle restricting projection 30*b* of the rotation angle restricting member 30, thereby restricting the rotation angle of the pressing member 8 and preventing any rotation in the hoisting-down direction beyond the restricted angle so as to prevent any further spiral retreat toward the axial tip.

The resilient force of the counterclockwise coil spring 38 is set to such a low level as to contribute to the loose rotation in the unload state. Therefore, since the great rotating force is exerted on the drive shaft 6 in the hoisting-down direction, i.e., counterclockwise, according to the weight of the load in the load state, the pressing member 8 is rotated in the hoisting-up direction with respect to the drive shaft 6. Furthermore, since the locking teeth 11*a* of the reverse rotation preventing ring 11 mesh with the ratchet pawl 12, the friction members 9 and 10 and the reverse rotation preventing ring 11 are pressed against the pressed member 7, thus holding the braked state.

As described above, in the lever hoist with the overload preventing device according to the present invention, the load limit can be easily adjusted and the adjusting efficiency can be enhanced. Furthermore, in the case where the load is to be hoisted up in the overload state, the flick generated when the locking tooth meshes with the subsequent tooth serves as an alarm. In addition, the hoisting-down operation can be easily performed even in the overload state.

Moreover, when the rotation drive member is rotated in the hoisting-up direction in the overload state, the rotation drive member is rotated while deformably compressing the urging member, to thus exert great urging force on the urging member and the nut. However, the rotation limiting member is interposed between the rotation drive member and the disk spring, and the engaging portion of the rotation limiting member engages with the portion to be engaged of the pressing member. Consequently, the rotating force of the rotation drive member with respect to the pressing member cannot be transmitted to the urging member and the nut. Therefore, even in the case where the rotation limiting member is rotated in the overload state, the nut cannot be tightened, and therefore, there is no danger of variations in the preset load limit. Additionally, it is unnecessary to stop the rotation of the nut at a specific position in setting the load limit, whereby the nut can be stopped after it is rotated by an optimum quantity.

What is claimed is:

1. A lever hoist with an overload preventing device comprising:

a drive shaft for transmitting rotating force to a load sheave;

a pressed member fixed to the drive shaft;

a reverse rotation preventing ring which is rotated in only one direction with respect to the drive shaft;

a pressing member screwed to the drive shaft in such a manner as to freely advance or retreat, and presses the pressed member via the reverse rotation preventing ring;

a large-diameter boss projecting from the pressing member toward an axial tip of the drive shaft;

a small-diameter boss projecting from the large-diameter boss toward the axial tip and having a screw groove formed at the circumferential surface thereof;

a rotation drive member rotatably fitted to the large-diameter boss of the pressing member in such a manner as to face the pressing member in the axial direction and having a plurality of drive teeth on the outer periphery thereof;

a plurality of locking teeth formed on each of the pressing member circumferential surface and the rotation drive member circumferential surface, such that the plurality of locking teeth formed on each of the pressing and rotation drive members mesh with each other; each of the plurality of locking teeth having a triangular cross section;

each of the plurality of locking teeth having a moderately inclined surface for pressing the pressing member when the rotation drive member is rotated in a hoisting-up direction;

each of the plurality of locking teeth having a sharply inclined surface for pressing the pressing member when the rotation drive member is rotated in a hoisting-down direction;

an engaging portion formed at a projecting portion of the large-diameter boss projecting toward the axial tip beyond the rotation drive member when the rotation drive member is fitted to the large-diameter boss;

a rotation limiting member having an outer diameter greater than the inner diameter of the rotation drive member, for restricting, at the outer peripheral edge thereof, movement toward the axial tip of the rotation drive member, and including, at the inner circumference thereof, an engaged portion to be engaged with the engaging portion at the tip of the large-diameter boss so as to inhibit relative rotation in a circumferential direction;

urging means fitted to the small-diameter boss nearer the axial tip than the rotation limiting member, and having urging force such that the locking teeth of the rotation drive member cannot ride over the sharply inclined surface of the locking tooth when the rotation drive member is rotated in the hoisting-down direction during a hoisting-down operation while the locking teeth of the rotation drive member can ride over the moderately inclined surface of the locking tooth when an overload is exerted on the rotation drive member during a hoisting-up operation; and a nut screwed into the small-diameter boss, for positioning the urging means with respect to the pressing member.

* * * * *